United States Patent [19]

Huber

[11] 4,269,466

[45] May 26, 1981

[54] CONNECTOR AND STRAIN RELIEF FOR FLAT TRANSMISSION CABLE

[75] Inventor: John H. Huber, Harrisburg, Pa.

[73] Assignee: AMP Incorporated, Harrisburg, Pa.

[21] Appl. No.: 97,072

[22] Filed: Nov. 23, 1979

[51] Int. Cl.[3] ..... H01R 13/58

[52] U.S. Cl. ..... 339/107; 339/97 R; 339/176 MF

[58] Field of Search ..... 339/97 R, 98 R, 17 R, 339/99 R, 99 L, 176 MF, 103 R, 103 M, 105, 107, 206 R, 206 P, 208

[56] References Cited

U.S. PATENT DOCUMENTS

| | | | |
|---|---|---|---|
| 3,336,565 | 8/1967 | Crimmins | 339/107 |
| 3,859,787 | 12/1974 | Snyder | 339/103 R |
| 3,864,011 | 2/1975 | Huber | 339/103 M |
| 3,879,099 | 4/1975 | Shaffer | 339/99 R |
| 3,907,396 | 9/1975 | Huber | 339/103 R |
| 3,920,306 | 11/1975 | Barnett et al. | 339/103 M |
| 4,080,035 | 3/1978 | Clark et al. | 339/103 M |
| 4,108,527 | 8/1978 | Douty et al. | 339/107 |

*Primary Examiner*—Eugene F. Desmond

[57] ABSTRACT

An electrical connector assembly is disclosed for terminating a flat transmission cable. The assembly comprises a body having forwardly disposed terminal members seated in oppositely facing surfaces thereof for terminating the cable conductors, and a pair of hermaphroditic connector covers for intended assembly over the oppositely facing body surfaces. Each cover is configured having a transverse tapered ridge extending thereacross at a rearward end thereof, and a transverse recess continuing thereacross in colinear alignment with the ridge. The ridge and recess of one cover are located in compliment to the recess and ridge of the opposite cover, and upon positioning the flat cable between rearward portions of the covers and swinging the covers into a mutually parallel relationship, the connector cover ridges deform a cable portion therebetween to adopt the profile of the intercover space and thereby effectuate secure clamping engagement between the covers and the flat transmission cable.

12 Claims, 19 Drawing Figures

CONNECTOR AND STRAIN RELIEF FOR FLAT TRANSMISSION CABLE

BACKGROUND OF THE INVENTION

1. Field of the Invention

The present invention relates to an electrical connector assembly for terminating a flat cable, and more specifically, a connector assembly having integral strain relief means.

2. The Prior Art

Copending patent application, Ser. No. 28,952, the disclosure of which hereby being corporated by reference, discloses a connector assembly for flat transmission cable comprising a connector body having terminal means therein, and two connector covers over opposite connector faces of the body. While this connector approach works well in principle, and has been generally well received by the industry, certain improvements have been made in response to the industry's needs. First, tensile stress introduced into the cable can tend to violate the integrity of the conductor terminations if mechanical isolation of the contact area is not preserved. Consequently, the industry is in need of a connector assembly having improved strain relief capability for mechanically isolating the termination area of the connector body. Moreover, the ideal connector in assembled form should be immune to inadvertent disassembly, and structural integrity of the resulting assembled connector is critical. Another desirable attribute in any proposed connector assembly would be to provide integral means for preventing overengagement between the assembled connector and the terminal posts intended for insertion therein. A further requirement is that any connector embodiment which solves the above set forth problems, do so with a simplicity of design and a maximum degree of parts standardization so as to make the connector conducive to mass production and the inherent cost savings associated therewith.

Achievement of a connector which can accomplish the above has been unsuccessful to date due to a myriad of factors. One factor has been that the subject connector assemblies must necessarily be relatively miniature in scale, and it is the small size of a connector which forecloses the utilization of existing strain relief technology in the connector configuration. The miniature size of the connector also places significant limitations on the degree to which a designer can rely upon material stock for achieving a strain relief function. Also, commercial cables which are intended to be terminated by such assemblies include an outer sheath or layer which often is extruded from polymer materials, e.g., teflon, which are difficult to mechanically clamp. Finally, besides resisting tensile manipulation on the cable, the desired connector assembly must also protect the termination area of the cable from any shearing manipulation of the cable.

SUMMARY OF THE INVENTION

The present invention accomplishes the above objectives by providing a connector assembly having improved strain relief means, and improved structural solidarity in the assembled state. The assembly comprises a body having forward terminal means seated in oppositely facing surfaces for terminating the cable conductors, and a pair of hermaphroditic covers intended for assembly over the oppositely facing body surfaces. Each cover is configured having an integral transverse tapered ridge extending partially thereacross at a rearward end thereof, and a transverse recess continuing thereacross in colinear alignment with the ridge. The ridge and recess of one cover are located in compliment to the recess and ridge of the opposite cover, respectively, and upon positioning the cable between rearward portions of the covers, and swinging the covers into a mutually parallel relationship, the connector cover ridges deform the cable therebetween to adopt the profile of the intercover space. The engagement so achieved between the connector covers and cable insulates the forward terminated end of the cable from tensile or shear forces introduced into the cable. Each cover is further adapted having projecting means at a forward end for interlocking engagement with the body of the assembly to securely attach the forward ends of the connector covers to the connector body, and thereby interlock the resulting assembly together to an optimal degree.

Accordingly, it is an object of the present invention to provide a connector assembly for achieving positive electrical and mechanical termination of a flat transmission cable.

It is further object of the present invention to provide a connector assembly for the termination of a flat transmission cable having improved strain relief means.

Still a further object of the present invention is to provide a connector assembly for the termination of a flat transmission cable featured having improved means for securing the assembly components together in an assembled state.

Still further, it is an object of the present invention to provide a connector assembly for the termination of a flat transmission cable featured having hermaphroditic cover members.

A still further object of the present invention is to provide a connector assembly for the termination of a flat transmission cable featured having integral means for preventing overengagement between the assembled connector and other terminal members.

Yet a further object of the present invention is to provide a connector assembly for the termination of a flat transmission cable which is economically and readily produced, and which is readily assembled.

These and other objects, which will be apparent to one skilled in the art, are achieved by a preferred embodiment which is described in detail below, and which is illustrated in the accompanying drawings.

BRIEF DESCRIPTION OF THE ACCOMPANYING DRAWINGS

DETAILED DESCRIPTION OF THE PREFERRED EMBODIMENT

Figure 2:
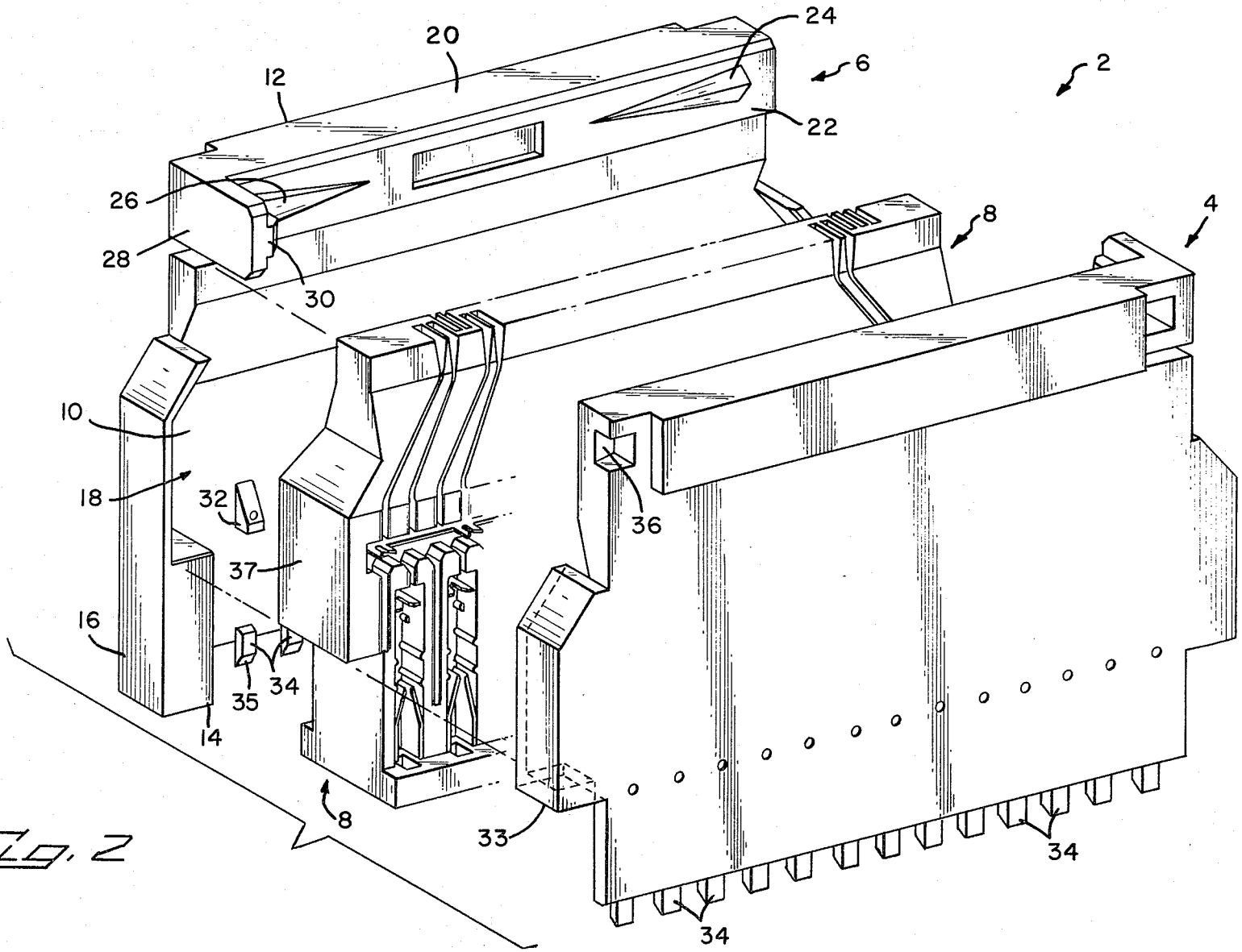
FIG. 2 is an exploded perspective view of the subject connector assembly.

The subject connector assembly 2, illustrated in FIG. 2, comprises a pair of hermaphroditic cover members 4, 6 and a connector body member 8. Each cover member is formed generally having a plate portion 10 extending from a rearward end 12 to a forward end 14, and profiled sides 16 each having a profiled opening 18 therein. Formed integrally with a rearward end of each cover member, a strain relief portion 20 is provided having an inwardly facing surface 22, with a V-shaped ridge 24 of tapered profile extending partially across surface 22 in the transverse direction. An elongate V-shaped recess 26 is also provided within the inwardly facing surface generally colinear with the cover's corresponding ridge, and is of increasing depth therealong in the transverse direction. A cantilever arm 28 is formed to project outwardly from one end of the strain relief portion 20 of each cover member; the arm 28 having an inwardly projecting flange 30 at the free end thereof. Intermediate the plate portion 10 of each cover member 4, 6 are a plurality of outwardly directed wedge-shaped stops 32 which are colinearly spaced across the plate portion 10. At the forward end 14 of each cover member are a plurality of spaced apart, forwardly directed stud projections 34, each having a beveled lower surface 35 so formed for a purpose explained below. A locking detent 36 is further provided each connector cover member at the rearward end thereof. It will be appreciated from FIG. 2 that the subject connector covers are preferably unitarily molded of plastics material having the above described structure. Each cover is profiled having a stop surface 33 formed therein.

Figure 3:
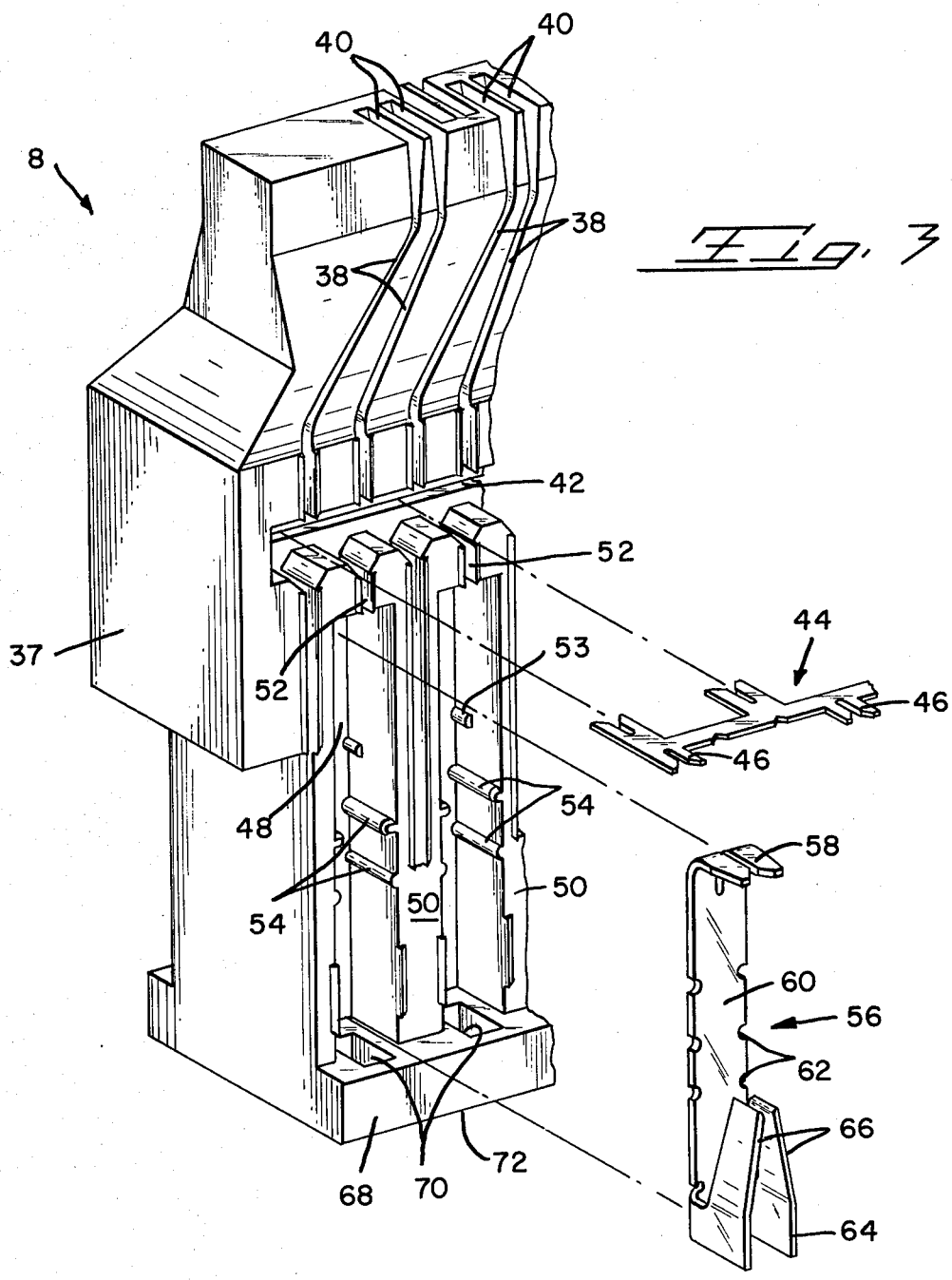
FIG. 3 is an exploded perspective view of the subject connector body having terminal members exploded therefrom.
Figure 3A:
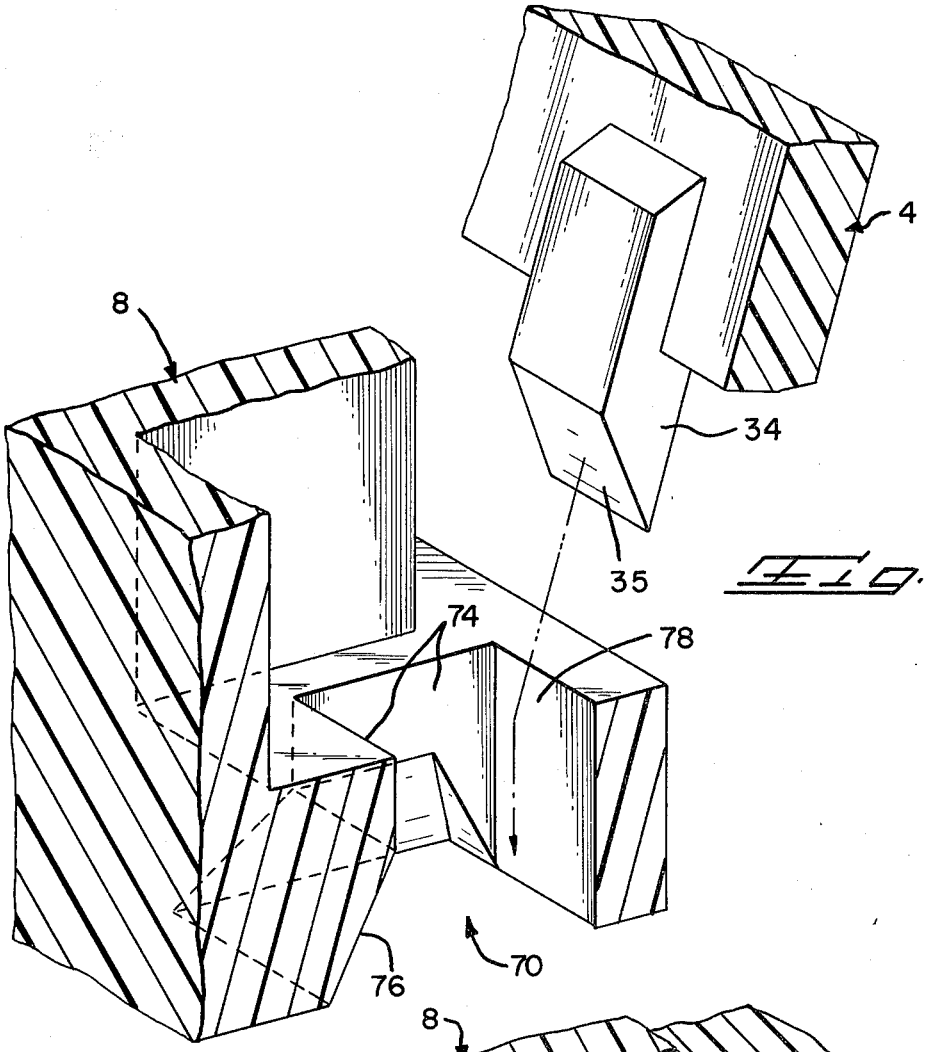
FIG. 3A is a section view of a forward passageway of the subject connector body having a connector cover stud projection positioned proximate thereto prior to insertion of the stud into the passageway.
Figure 10:
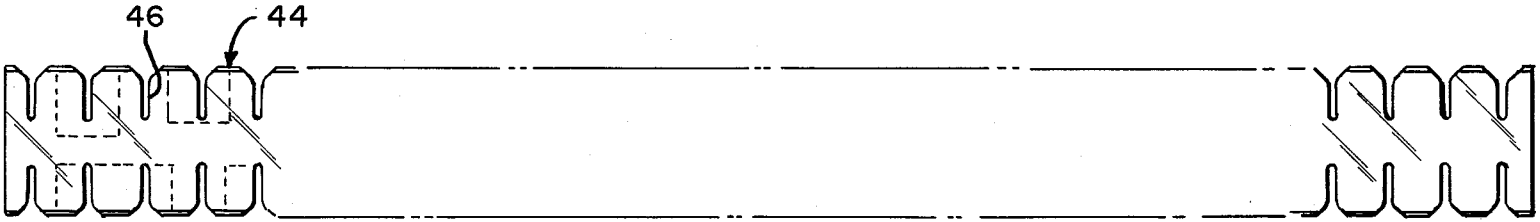
FIG. 10 is a top planar view of a strip blank from which the ground bus bar member of the present invention is struck.
Figure 11:
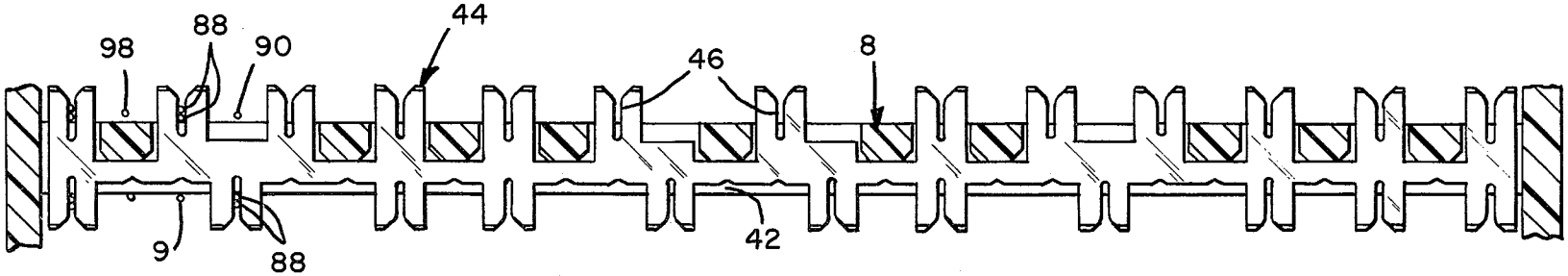
FIG. 11 is a transverse view of the present connector assemblies ground bus bar seated within the connector body and having cable ground conductors terminated thereto.

Referring now to FIGS. 2 and 3, the subject connector body 8 is profiled having an external shoulder 37. Shoulder 37 is necessary for one intended application of the present invention, but it should be noted that the principles of the present invention would be served as well by a body member having a non-contoured side profile. A plurality of conductor receiving channels 38 are formed within oppositely facing surfaces 39 of the body 8 (only one surface 39 being shown, however, the opposite surface of the body 8 is identically configured). Each channel 38 has a funnel entry portion 40 structured in accordance with the teachings of the above-identified copending application incorporated herein. An elongate ground bus slot 42 extends transversely of the connector body within surface 39, with integral retention stakes 43 (FIG. 4) provided at the base of the slot 42. As illustrated by FIGS. 3, 10, and 11, the ground bus bar 44 is stamped from a continuous blank, and includes a plurality of offset ground conductor terminating slots 46. The connector body (FIG. 3) further comprises a plurality of terminal-receiving cavities 48 positioned serially across the connector body 8, adjacent cavities 8 being separated by integral barriers 50. Each terminal-receiving cavity communicates with the bus slot area of the connector body by means of through channels 52. Opposing retention ribs 53 and alignment ribs 54 are integrally formed down sidewalls of the terminal-receiving channels 48. A plurality of terminal members 56 are intended for use within the connector body, each terminal 56 being configured having a single termination slot 58 at a rearward end for terminating a signal conductor of the subject cable, an intermediate shank portion having oppositely located alignment tracks 62 formed therein, and a forward female-type receptacle portion 64 comprising inwardly biased tines 66. The connector body 8 includes a forward barrier 68 having an array of profiled passageways 70 formed therethrough, each passageway 70 extending from a forward face 72 of the connector body 8 and communicating with a single terminal-receiving cavity 48. The passageways 70 are each defined by internal sidewalls 74 as best illustrated by FIG. 3A, and each sidewall 74 is structured having an outwardly flared planar bottom surface 76. A planar sidewall 78, not having the above flared surface portion, defines one side of the passageway as indicated.

Figure 1:
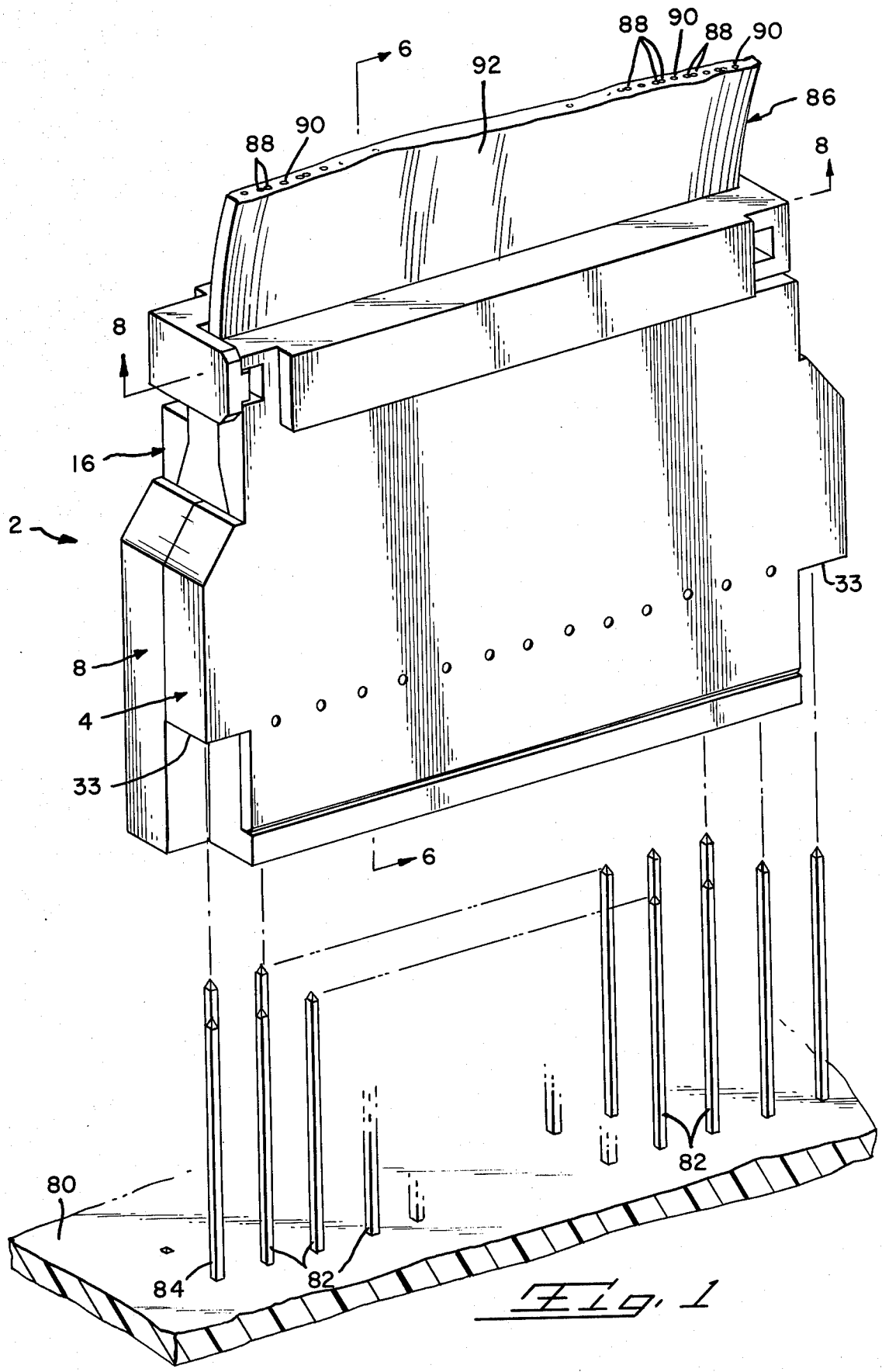
FIG. 1 is an assembled view of the subject connector assembly with a printed circuit board intended for use therewith.

The subject connector assembly 2, as shown in FIG. 1, is intended to matingly plug onto a printed circuit board 80 having parallel rows of pins 82 projecting outwardly therefrom. A pair of polarizing pins 84 are provided at the ends of one row of pins 82, and are intended to serve a key-in function described in detail below. The present connector assembly is intended to terminate a flat transmission cable 86 comprised of alternately disposed parallel dual ground wires 88 and signal conductors 90. The ground conductors 88 and signal conductors 90 are encased within an outer sheath 92 typically extruded from plastics material. While the present invention has specific utility in terminating the cable illustrated in FIG. 1, it should be appreciated that other flat transmission cables having different configurations could also be terminated according to the teachings herein set forth.

Figure 4:
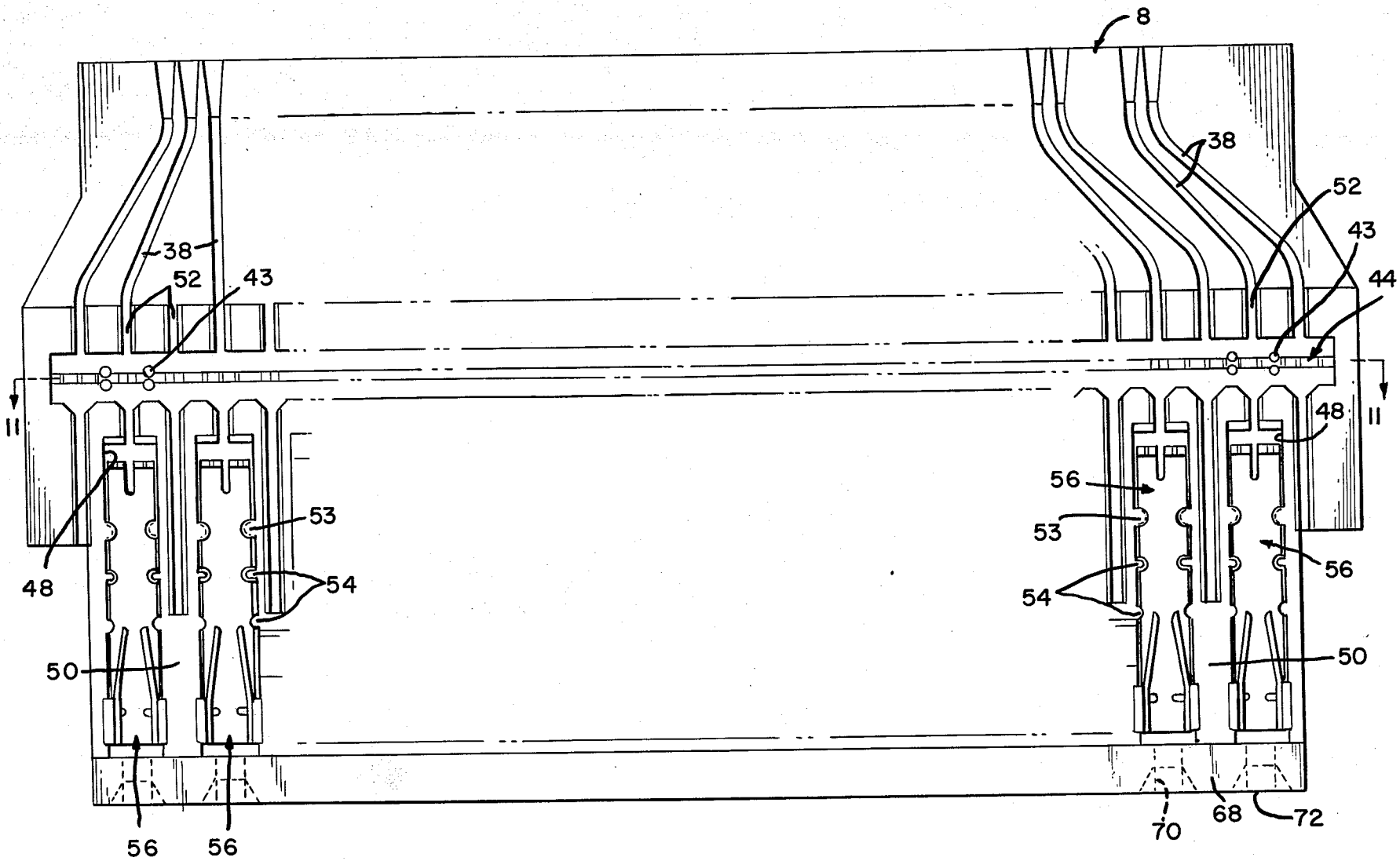
FIG. 4 is a top planar view of the subject connector body having the terminal members seated therein pursuant to the teachings of the present disclosure.

Assembly of the present invention proceeds as follows. Referring to FIGS. 3 and 4, the ground bus bar terminal 44 is inserted into the connector body slot 42 between the retention stakes 43. There positioned the ground bus terminal extends transversely of the body 8 between from one side thereof to the other side. The plurality of terminal members 56 are likewise inserted into the connector body 8, and each terminal 56 is positioned in one terminal-receiving cavity 48 with the retention ribs 53 and alignment ribs 54 aligned with appropriately provided alignment guide tracks 62 as shown. The retention ribs 53 are thereafter inwardly stuck over to securely retain the terminal members within the connector body 8.

Figure 6A:
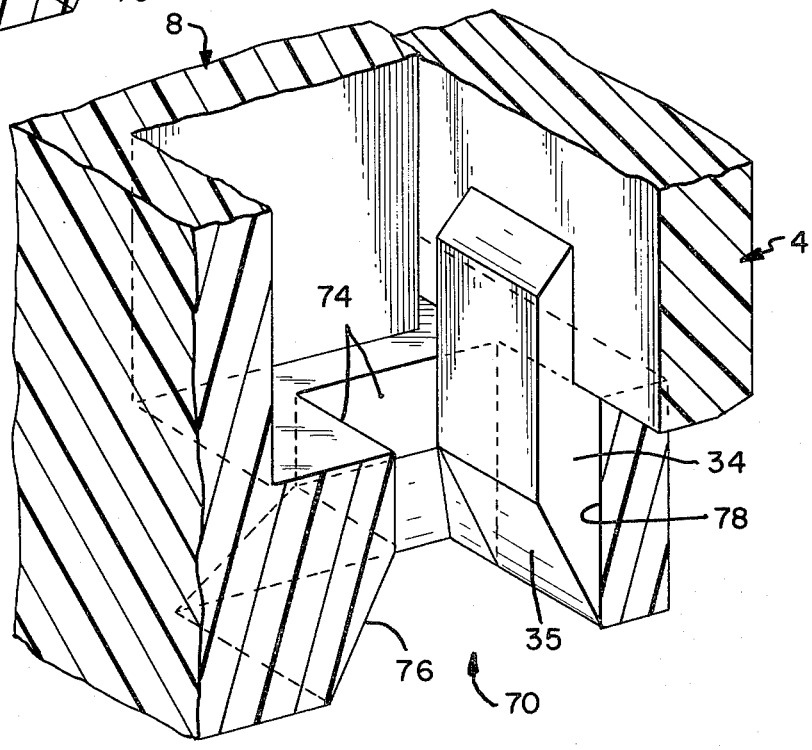
FIG. 6A is a perspective view in section of one connector body forward passageway having a stud projection of the connector cover positioned therein.
Figure 5:
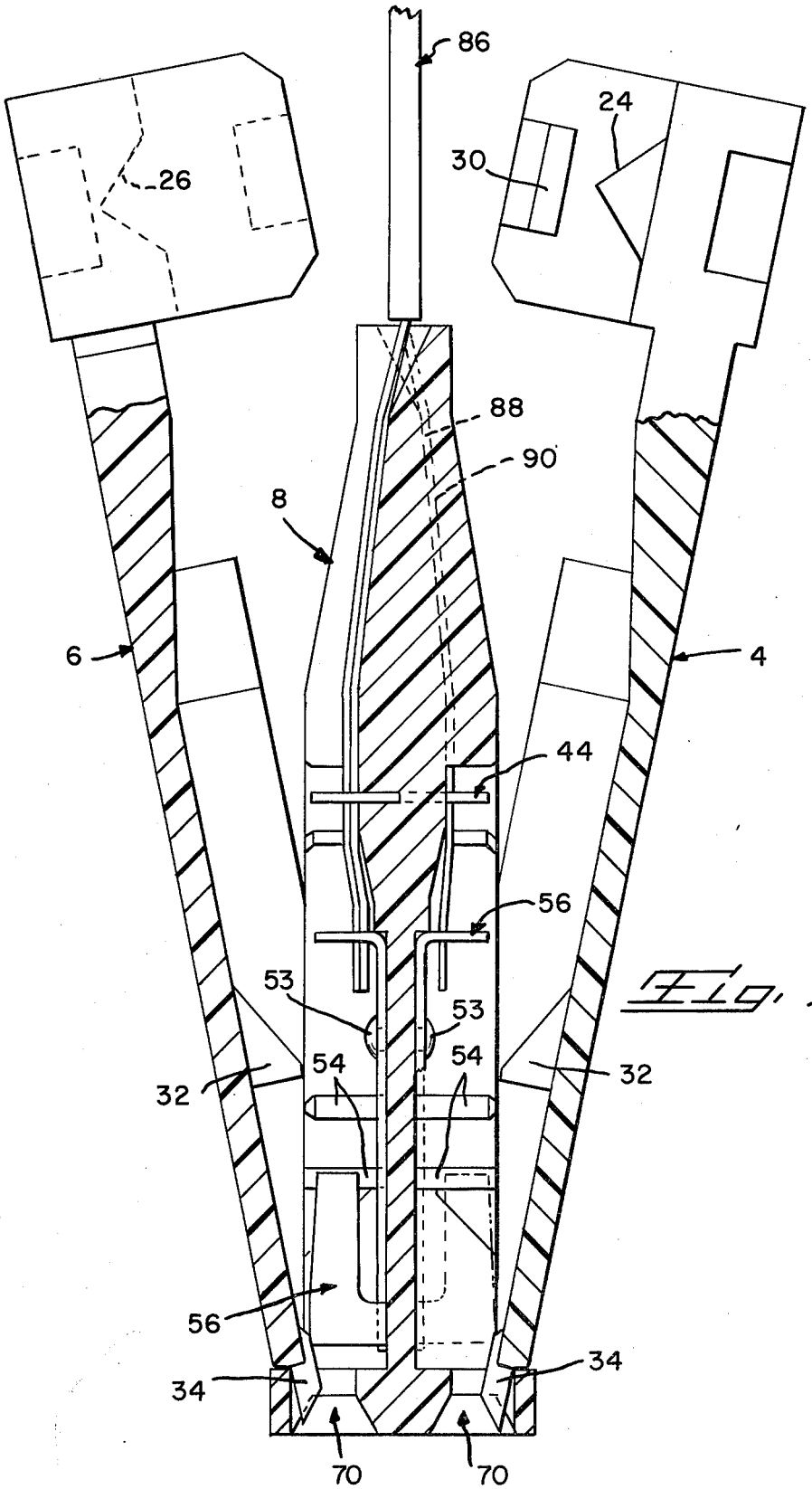
FIG. 5 is a side elevation view taken in section of the present connector assembly at a preliminary stage in the assembly procedure.
Figure 6:
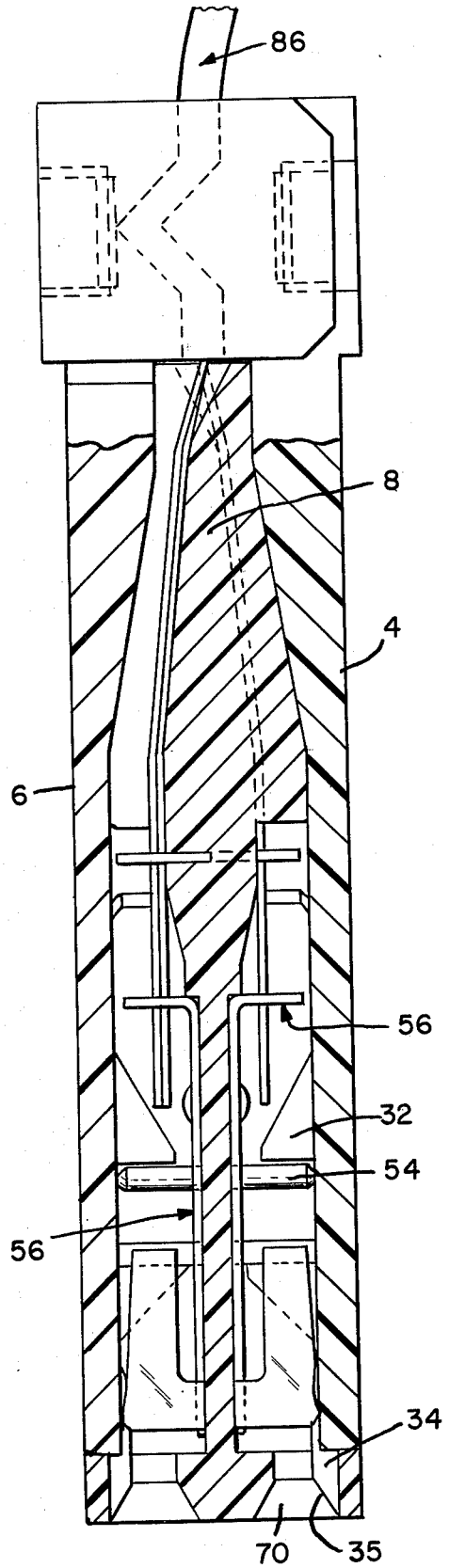
FIG. 6 is a side elevation view taken in section of the present connector assembly in the fully assembled condition.

Continuing with reference to FIG. 5, the flat transmission cable 86 is prepared so that the signal conductors 90 and the ground conductors 88 extend forward free of the outer insulative sheath 92. The exposed conductors 88, 90 are rolled into the conductor directing channels 38 and thereby are positioned against the connector body 8 in a prescribed spacing. The ground conductors 88 are simultaneously terminated into the ground bus terminal slots 46, and the signal conductors 90 are terminated in the signal terminating slots 58 of the terminal members 56. The connector covers 4, 6 are then brought to the connector body 8, with each of the stud projections 34 inserted into a single passageway 70. Thereafter, as illustrated in FIG. 6, the connector covers 4, 6 are pivoted toward the connector body 8 and into a mutually parallel orientation. Resultingly, the stud projections 34 pivot against the planar sidewalls 78 of the passageways 70 (FIG. 6A), the wedge shaped projections of each cover are moved to project into the terminal-receiving cavities 48 of the connector body, and the locking cantilever arm 78 of the connector covers 4, 6 engage the detent 36 of the opposite connector cover to detactably lock the connector covers and the connector body together. As shown best by FIGS. 8 and 9, the ridge 24 of each connector cover serves to influence the flat transmission cable into the recess 26 of the opposite connector cover, whereby the flat transmission cable is deformed to adopt the profile of the passageway defined between the two connector covers. Tight grasping control over the flat transmission cable is achieved due to the V-shape and tapered profile of the ridge and recess portions of the covers since the deformed cable is constrained laterally of its axis by abutment against the sides of the V-shaped ridge and its longitudinal taper. Further, deformation of the flat transmission cable achieves an improved strain relief as the cable is tightly clamped and resists pulling out of the connector body under the influence of tensile force introduced into the cable.

Figure 7:
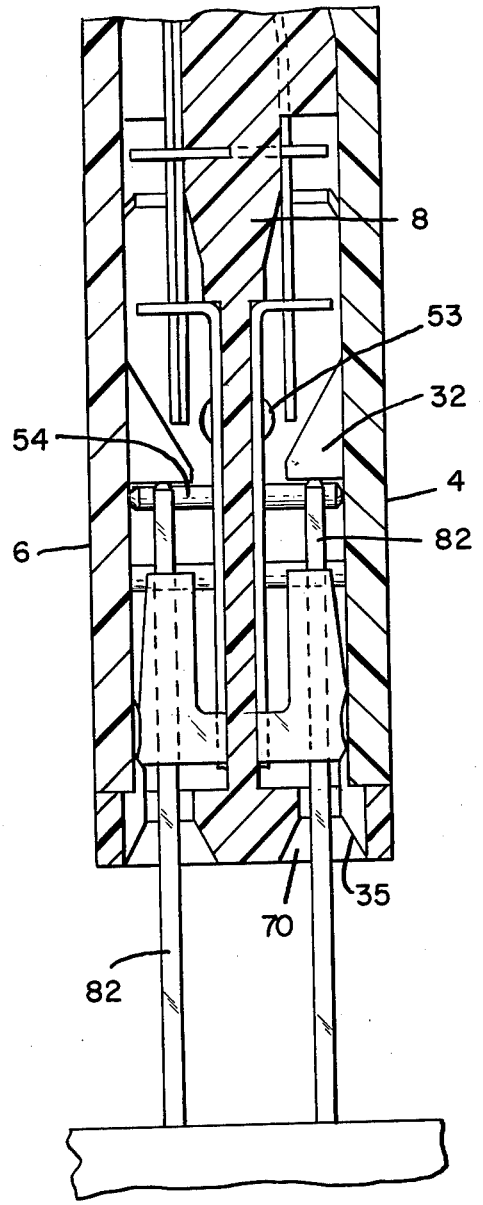
FIG. 7 is a frontal view in section of the subject connector assembly in the assembled condition in mating engagement with a printed circuit board pin field.
Figure 12:
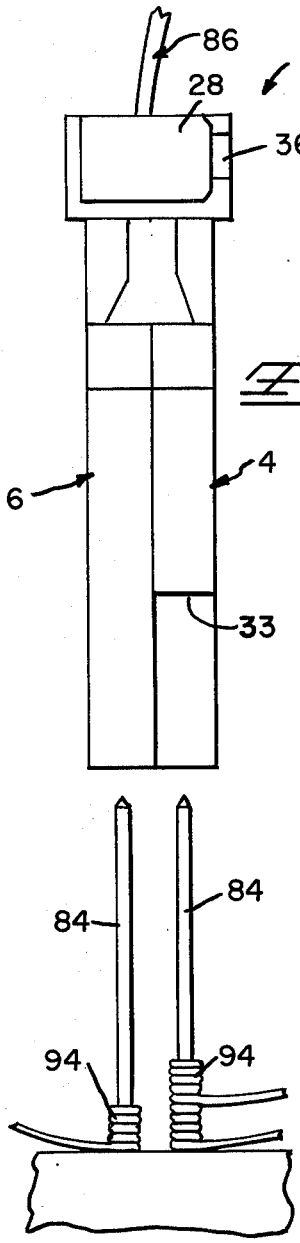
FIG. 12 is a side elevation view of the present connector assembly shown prior to mating engagement to a printed circuit board pin field.
Figure 13:
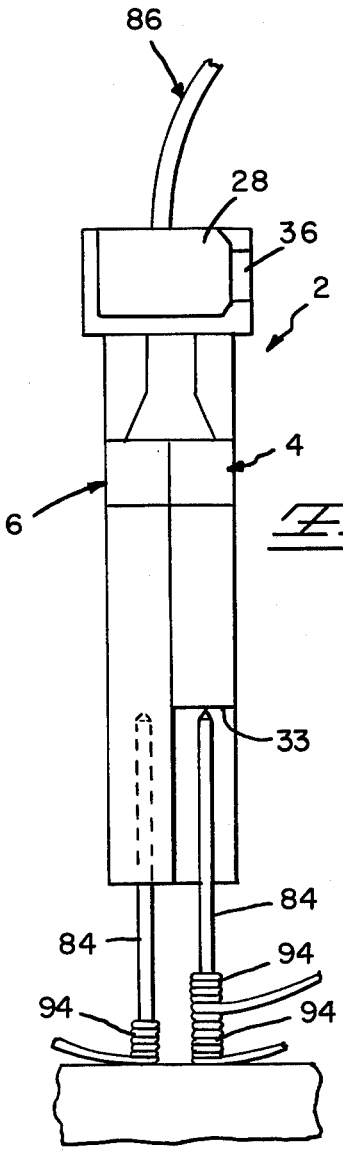
FIG. 13 is a side elevation view of the present connector assembly shown subsequent to mating engagement with a printed circuit board pin field.

The subject connector is illustrated in an assembled state in FIGS. 6 and 12, and intended operation of the connector assembly is presented in FIGS. 7 and 13. As shown, the subject connector is intended for mating engagement with dual rows of printed circuit board pins having a pair of keying pins provided to orient the connector thereupon. Overinsertion of the connector body onto the pins is precluded by inhibiting abutment of the pins against internal wedge shaped stops 32 provided by the connector covers, and in this manner the cable conductor termination area of the connector body is protected. As shown in FIG. 13, the keying pins 84 of the printed circuit board do not enter a passageway 70 to mate with a terminal member, but rather remain external to the connector body and engage the stop surfaces 33 of the connector covers. Accordingly, the connector is prevented from an overengagement downward against the board itself. Since interconnection to the pins is by fine gauge wire wraps 94, it is critical to prevent the connector from being inadvertently forced upon the wrapping area of the pins.

Figure 14:
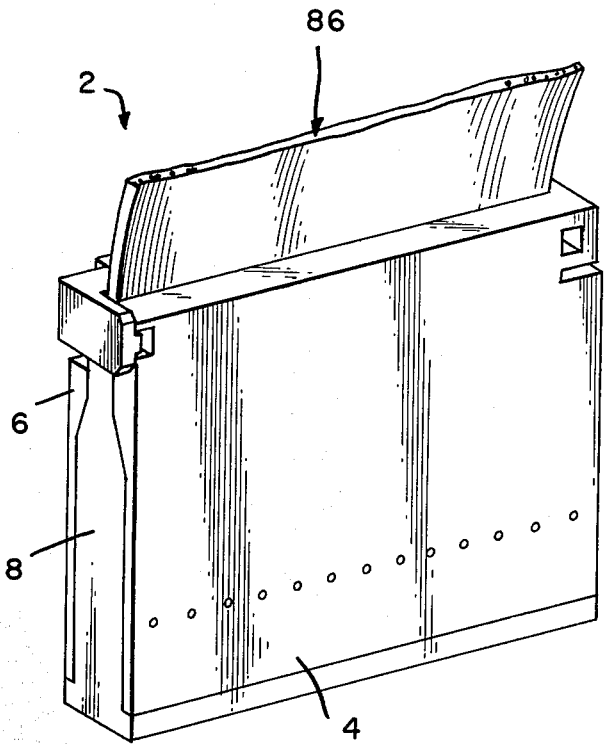
FIG. 14 is a perspective view of an alternative embodiment of the present invention.
Figure 15:
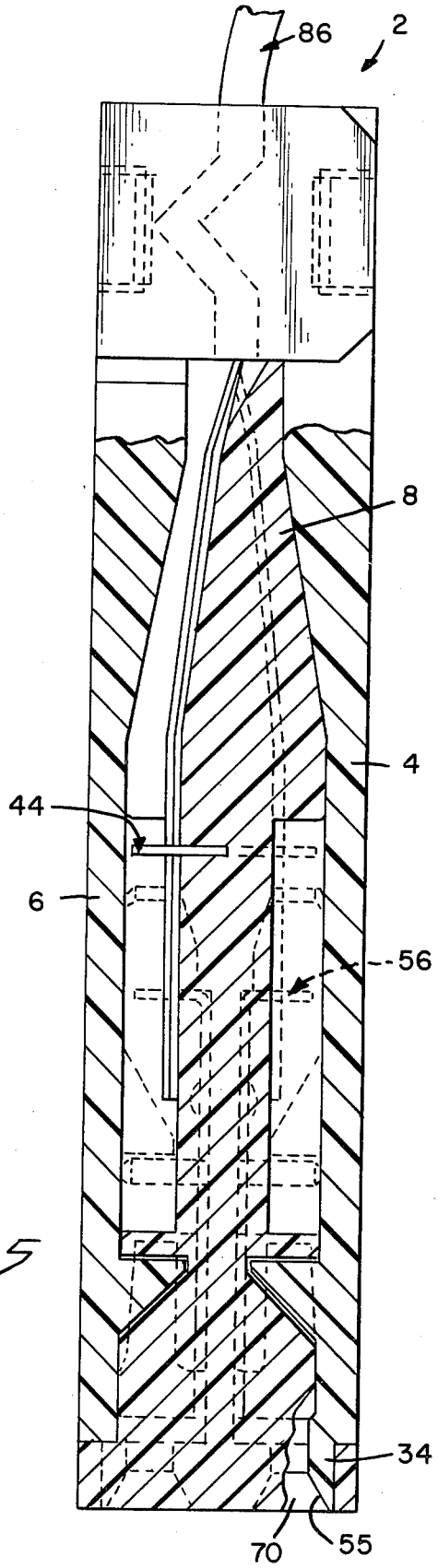
FIG. 15 is a side elevation view taken in section of the alternative embodiment of the present invention depicted in FIG. 14.
Figures 16, 17:
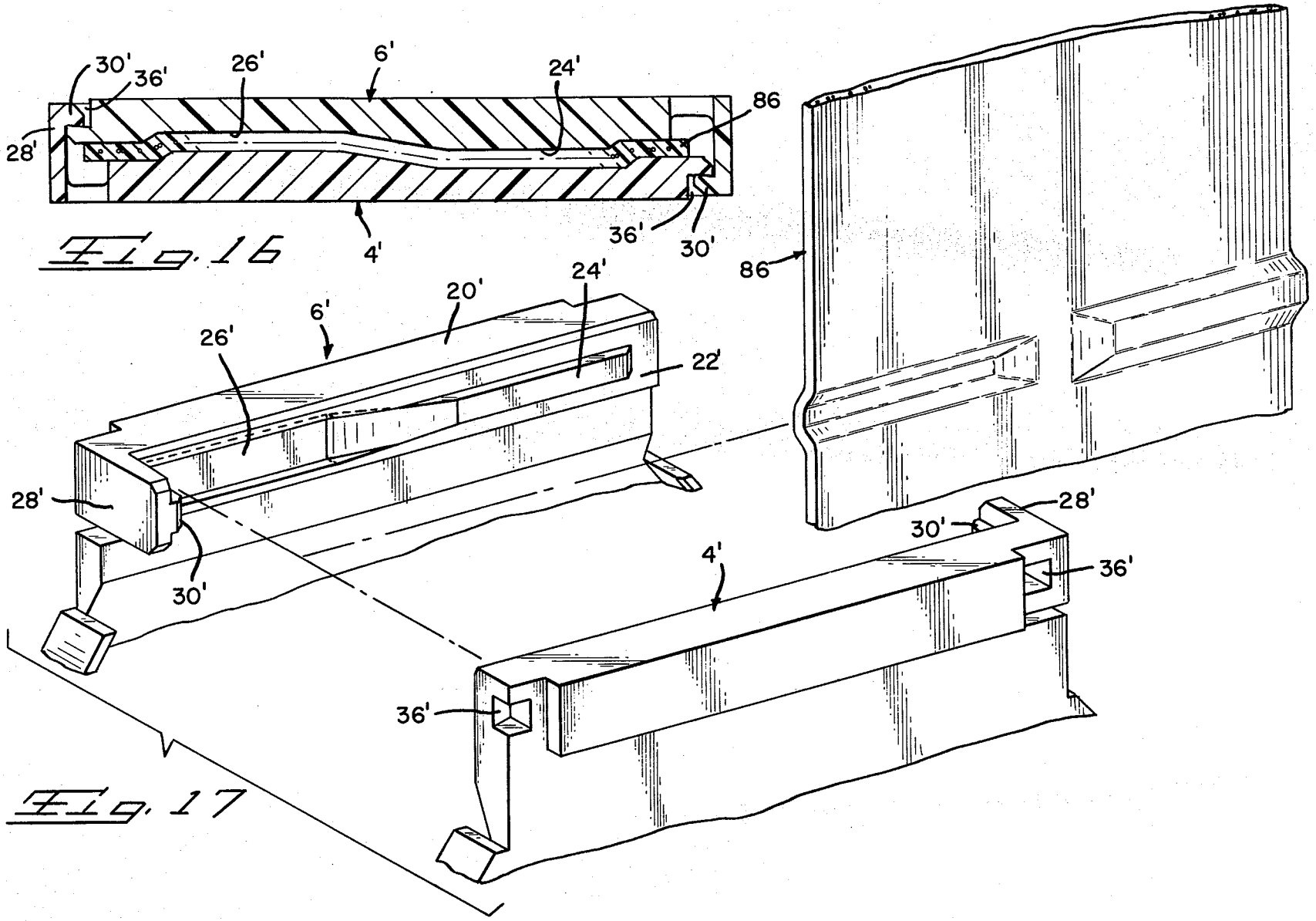
FIG. 16 is a transverse sectional view of a connector assembly according to the present invention having an alternative cable strain relief configuration.
FIG. 17 is a perspective view of the alternative cable strain relief structure shown in FIG. 16 and the transmission cable deformed thereby in accordance with the present invention teachings.

An alternative embodiment of the present invention is illustrated in FIG. 14, and it will be appreciated from a viewing of FIG. 14 that the alternative embodiment has a planar external profile on the sides, and therefore is not intended for use on a pin array of the type set forth above. In all other respects, however, the alternative embodiment depicted in FIG. 14 is structurally similar to the embodiment of FIG. 1. FIG. 15 illustrates the alternative embodiment in transverse section, and it should be noted that the operation of the alternative connector of FIGS. 14 and 15 proceeds in the same manner as described above for the preferred embodiment. FIG. 16 shows in transverse section an alternative strain relief structure, employing ridges and recesses tapered in the manner set forth above; however, the ridges and recesses of the alternative embodiment are not of a dramatic V-shape as the preferred embodiment outline above. Acceptable performance can be obtained, however, since opposed ridges and recesses in both embodiments serve to clampingly deform the cable positioned therebetween. It should be noted that the strain relief function is achieved by the interfitting of ridges and recesses according to the present invention absent any external strain relief members since the strain relief ridges and recesses are integral to the connector covers themselves. Further, it should be noted that the present connector assembly is structurally secure since the connector covers are integrally tied to the connector body by means of the interfitting engagement of the stud projections into the body passageways 70. FIG. 17 illustrates the deformation that occurs when ridges and recesses of the connector covers are pressed against the cable. As shown, the deformation occurs to the outer insulative sheath of the cable, but the conductors themselves are not broken during the assembly procedure. Nor is the transmission effectiveness of the cable detrimentally affected. By deforming the transmission cable outer sheath, positive grasping engagement of the cable is achieved. Moreover, the tapered ridge and recess profile of the cable strain relief provides strain relief support of the cable from forces on the cable in either axial or transverse directions. Thus, the connector covers mechanically isolate the terminated ends of the conductors from externally originating stress of the cable.

Figure 8:
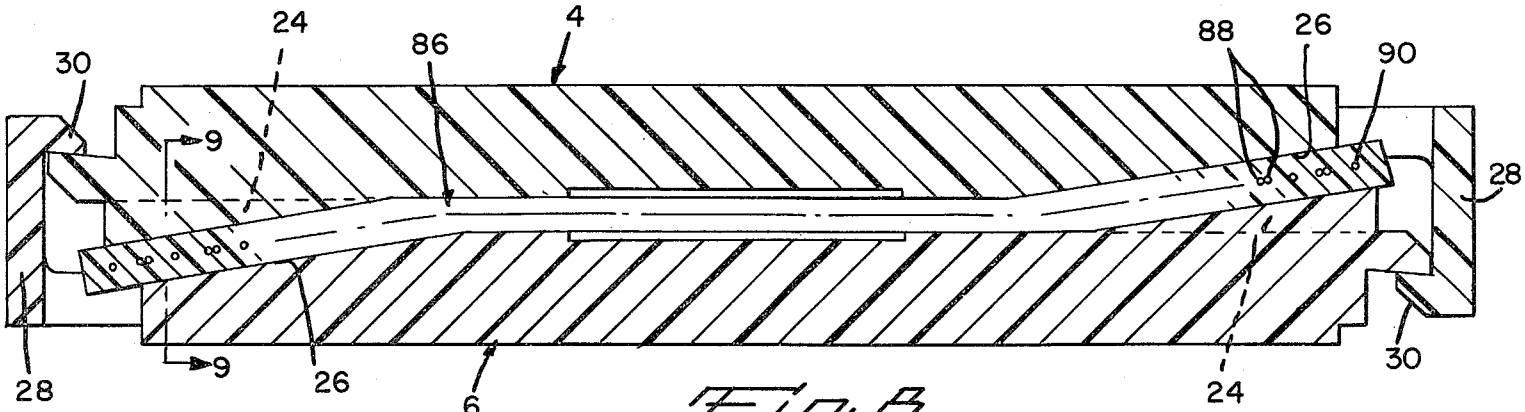
FIG. 8 is a transverse section view of the present invention in the assembled condition and illustrating structure operating as a strain relief.
Figure 9:
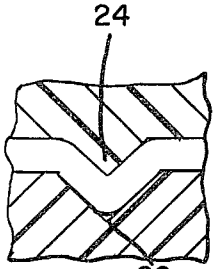
FIG. 9 is a section view of the strain relief structure of the present invention taken along the line 9—9 of FIG. 8.

In general reference to FIGS. 8 and 17, it is intended that the preferable location of the deformations, or dimples, in the cable be proximate the sides of the cable, although strain relief would be achieved were the dimples made centrally of the cable. Said side location of the dimples increases the cable draw-out force threshold considerably, and prevents any unwanted buckling of the cover from occurring. Also, note that the strain relief configuration, in its broadest sense, requires only ridges or protrusions to effectuate the dimpled deformations in opposite surfaces of the cable, located proximate a side thereof. Incorporation of complimentary recess structure in each cover beneficially aids cable deformation, but a dimple could nonetheless be created in the cable by the ridges without a complimentarily positioned recess being provided in the opposite cover.

It should be appreciated that the preferred embodiment described in detail above may be subjected to many changes and alterations without departing from the spirit or intent of the present invention, and such modifications of such departures are intended to be within the scope of the present invention.

I claim:

1. An electrical connector for terminating a plurality of conductors in a transmission cable, comprising:

a connector body having a conductor receiving end, a profiled mating end opposite said conductor receiving end, and oppositely directed surfaces extending from said conductor receiving end to a position adjacent said mating end;

said connector body having terminal means proximate said profiled mating end and each said surface of said body having conductor channeling means extending from said conductor receiving end for directing selected ones of said conductors therealong into terminated engagement with said terminal means;

a pair of profiled connector covers each mounted in apposition to a respective one of said connector body surfaces, and each said cover having profiled latching means engaging said body, and profiled strain relief means at a rearward end projecting beyond said conductor receiving end of said body;

said strain relief means comprising an integrally formed transverse ridge extending partially across an inwardly directed surface of said each cover, and an integral transverse recess within said cover surface extending partially thereacross generally in colinear alignment with said transverse ridge, said ridge of one said cover opposing said recess of the opposite said cover and being spaced apart therefrom so that a cable portion constrained therebetween adopts the ridged and recessed profile of each said connector cover in a clamped engagement with said covers.

2. A connector as set forth in claim 1 wherein each said cover having locking means at said rearward end for engaging like locking means of the opposite said cover to hold said covers in a locked condition.

3. A connector as set forth in claim 1 wherein said terminal means comprising a plurality of terminal members seated in a like plurality of cavities within said oppositely directed surfaces of said connector body, and said connector body mating end comprising a forward face having a plurality of profiled passageways therethrough each communicating with one said cavity and each said passageway being defined by an internal surface and internal sidewalls;

said cover latching means comprising a plurality of integral projecting studs at a forward end of each said cover each adapted and spaced for entry into one of said connector body passageways and adapted for pivotal movement into abutment against said internal passageway surface upon said mounting of said cover against said body surface.

4. A connector as set forth in claim 3, wherein each said stud and said internal passageway surfaces having inwardly facing beveled surfaces diverging outwardly to said forward face.

5. A connector as set forth in claim 1, wherein said strain relief means ridge being profiled to ramp toward said inwardly directed surface of said cover, and said transverse recess within said inwardly directed surface of said cover being of increasing depth therealong in complement to said ramped profile of said ridge of said opposite cover.

6. A connector as set forth in claim 5, wherein said strain relief means ridge and recess being of generally a V-shape.

7. A connector as set forth in claim 1, wherein said terminal means comprising a plurality of terminal members seated in a like plurality of cavities within said oppositely directed surfaces of said connector body, and each said connector cover having a like plurality of profiled stop projections, each dimensioned and located to project inwardly into one of said cavities and said terminal member seated therein to blockade a rearward conductor engaging end of said terminal member from a forward mating terminal end.

8. A connector as set forth in claim 1, wherein said connector covers are hermaphroditically configured.

9. A strain relief assembly for flat electrical cable, comprising:

a pair of profiled covers each intended for engagement against one respective surface of said cable in opposition to the other of said covers, and each said cover having a transverse ridge portion extending partially across an inwardly directed surface of said each cover, and a transverse recess within said inward cover surface extending thereacross in substantially colinear alignment with said transverse ridge, said ridge of one said cover opposing said recess of the opposite said cover and being spaced apart therefrom so that said cable constrained between said covers adopts the ridged and recessed profile of each said cover in clamped engagement with said covers.

10. A strain relief assembly as set forth in claim 9, wherein said cover ridge being profiled to ramp toward said inwardly directed cover surface, and said transverse recess within said inwardly directed cover surface being of increasing depth therealong in complement to said ramped profile of said ridge of said opposite cover.

11. A strain relief assembly as set forth in claim 10, wherein said cover ridge and recess being of generally a V-shape.

12. A strain relief assembly as set forth in claim 9, wherein said ridge and recess of each said cover being located proximate alternate sides of said cover.

* * * * *